US009435537B2

(12) United States Patent
ELKady et al.

(10) Patent No.: US 9,435,537 B2
(45) Date of Patent: Sep. 6, 2016

(54) SYSTEM AND METHOD FOR PREMIXER WAKE AND VORTEX FILLING FOR ENHANCED FLAME-HOLDING RESISTANCE

(75) Inventors: Ahmed Mostafa ELKady, Guilderland, NY (US); Christian Lee Vandervort, Voorheesville, NY (US); Kishore Ramakrishnan, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 1345 days.

(21) Appl. No.: 12/956,187

(22) Filed: Nov. 30, 2010

(65) Prior Publication Data

US 2012/0131923 A1 May 31, 2012

(51) Int. Cl.

| | |
|---|---|
| ***F23R 3/14*** | (2006.01) |
| ***F23R 3/12*** | (2006.01) |
| ***F23R 3/28*** | (2006.01) |

(52) U.S. Cl.

CPC . *F23R 3/14* (2013.01); *F23R 3/12* (2013.01); *F23R 3/286* (2013.01); *F23D 2900/14021* (2013.01)

(58) Field of Classification Search

CPC ..... F23C 2900/07001; F23D 2900/00008; F23D 2900/14004; F23D 2900/14701; F23R 3/14; F23R 3/286

USPC ..... 60/737, 740, 742, 746, 748; 239/399, 239/401, 402, 403, 404, 405

See application file for complete search history.

(56) References Cited

U.S. PATENT DOCUMENTS

| | | | | |
|---|---|---|---|---|
| 5,315,815 | A * | 5/1994 | McVey | F23R 3/12 239/402.5 |
| 5,647,200 | A | 7/1997 | Althaus | |
| 6,186,775 | B1 | 2/2001 | Jansohn et al. | |
| 6,993,916 | B2 * | 2/2006 | Johnson et al. | 60/776 |
| 7,543,452 | B2 | 6/2009 | Reba et al. | |
| 8,312,722 | B2 | 11/2012 | York et al. | |
| 8,959,922 | B2 | 2/2015 | Colmegna et al. | |
| 2002/0174656 | A1 * | 11/2002 | Hein | 60/737 |
| 2005/0097889 | A1 * | 5/2005 | Pilatis et al. | 60/743 |

(Continued)

FOREIGN PATENT DOCUMENTS

| | | |
|---|---|---|
| CN | 101725984 A | 6/2010 |
| CN | 201593806 U | 9/2010 |

(Continued)

OTHER PUBLICATIONS

K. Knowles; A. J. Saddington, "A review of jet mixing enhancement for aircraft propulsion applications", Proc. IMechE, vol. 220, Part G, J. Aerospace Engineering, pp. 103-127, 2006.

(Continued)

*Primary Examiner* — Phutthiwat Wongwian
*Assistant Examiner* — Marc Amar
(74) *Attorney, Agent, or Firm* — Ann M. Agosti

(57) ABSTRACT

A combustion system premixer includes one or more streamwise vortex generators configured to passively redirect surrounding high velocity air into at least one of wake and vortex regions within a combustion system fuel nozzle in response to air passing through the premixer. The streamwise vortex generators operate to minimize turbulent flow structures, thus improving air/fuel mixing, and enhancing resistance to flame-holding and flash-back within the premixer.

9 Claims, 7 Drawing Sheets

(56) References Cited

U.S. PATENT DOCUMENTS

| | | | | |
|---|---|---|---|---|
| 2006/0156734 | A1 | 7/2006 | Bland | |
| 2009/0111063 | A1 | 4/2009 | Boardman et al. | |
| 2009/0272117 | A1* | 11/2009 | Wilbraham | 60/748 |

FOREIGN PATENT DOCUMENTS

| | | | |
|---|---|---|---|
| EP | 0931980 | B1 | 7/1999 |
| EP | 0797051 | A1 | 2/2003 |
| EP | 1921377 | A2 | 5/2008 |
| EP | 2169307 | A1 | 3/2010 |
| JP | H10-009515 | A | 1/1998 |
| JP | 2001-254947 | A | 9/2001 |
| JP | 2003042453 | A | 2/2003 |
| JP | 2003074855 | A | 3/2003 |
| JP | 2006-090602 | A | 4/2006 |
| JP | 2008-096066 | A | 4/2008 |
| JP | 2009-109180 | A | 5/2009 |
| JP | 5312599 | B2 | 10/2013 |
| NL | WO 2010034819 | A1 * | 4/2010 ..... F23D 14/22 |
| WO | 9906767 | A1 | 2/1999 |
| WO | 2007131818 | A1 | 11/2007 |
| WO | WO 2007131818 | A1 * | 11/2007 |
| WO | 2010034819 | A1 | 4/2010 |

OTHER PUBLICATIONS

M. G. Mitchell; L. L. Smith; A. R. Karagozian; O. I. Smith, "Burner Emissions Associated With Lobed and Non-Lobed Fuel Injectors", Twenty-Seventh Symposium (International) on Combustion/The Combustion Institute, 1998/pp. 1825-1831.

Chinese Office Action issued in connection with corresponding CN Application No. 20111040311.7 on Mar. 30, 2015.

French Office Action issued in connection with corresponding FR Application No. 1160994 on Mar. 27, 2015.

Japan Office Action issued in connection with corresponding JP Application No. 2011-258401 on Nov. 24, 2015.

* cited by examiner

SYSTEM AND METHOD FOR PREMIXER WAKE AND VORTEX FILLING FOR ENHANCED FLAME-HOLDING RESISTANCE

BACKGROUND

The invention relates generally to gas turbine combustion systems and more particularly to a technique for increasing flame-holding resistance, and enhancing fuel air mixing of a combustion system premixer.

Premixed combustion of natural gas or fuel oil has been commercially proven to be a highly effective means of minimizing NOx emissions for land based gas turbines. Similarly, partial premixing is commonly applied to achieve analogous emission reduction in aircraft engines. This mode of combustion introduces a risk of premature combustion or flame-holding when this premixed air-fuel flow ignites upstream of the intended combustion region. If the upstream region is not designed to sustain the high temperatures associated with combustion, overheating of components and subsequent hardware distress can occur. Increasing the premixing capabilities of a fuel-oxidizer is known to also increase potential combustion dynamics issues that may cause hardware damage.

One technique that has been employed to increase premixing capabilities of a fuel/air premixer makes use of an array of air passages. Another technique employs the use of premixing vanes to provide a swirl-stabilized premixer. Yet another technique that has been employed to increase premixing capabilities of a fuel/air premixer includes cratered fuel injection holes that additionally increase resistance to flame-holding.

These known premixer techniques, although offering advancements in mixing capability or resistance to premixer flame-holding, leave room for improvements to further optimize mixing capabilities and flame-holding margins for combustion system premixers. One modern mixing technique employs trailing edge features for both, signature and noise reduction, e.g. jet noise from aircraft engines. Such trailing edge features have not been investigated as a technique to enhance fuel/air premixing and resistance to premixer flame-holding within a combustion system premixer.

In view of the foregoing, it would be advantageous to provide an air/fuel premixing structure that preserves or increases the air/fuel mixing capabilities of known combustion system premixer structures associated with all types of gas turbine combustors, while providing increased margins to flame-holding. The air/fuel premixer structure should advantageously employ passive techniques to preserve or increase air/fuel mixing capabilities and increase resistance to flame-holding, while optionally minimizing regions of momentum deficit within the premixer.

BRIEF DESCRIPTION

Briefly, in accordance with one embodiment, a combustion system premixer is provided to increase resistance to flame-holding in land based combustions systems. The premixer comprises:

one or more streamwise vortex generators configured to passively redirect surrounding high velocity air to fill in wake and vortex regions within a fuel nozzle in response to air passing therethrough.

According to another embodiment, a method of increasing resistance to flame-holding within a combustion system premixer comprises:

providing one or more streamwise vortex generators on one or more portions of a premixer;

and passing air through at least one premixer streamwise vortex generator such that the air passing through each streamwise vortex generator is passively redirected into wake and vortex regions of a corresponding fuel nozzle.

According to yet another embodiment, a combustion system premixer comprises:

at least one trailing edge region comprising one or more injection orifices, and further comprising one or more streamwise vortex generators, wherein the one or more streamwise vortex generators are configured to passively redirect surrounding high velocity air or fuel injected into the trailing edge region via the one or more injection orifices such that the redirected air or fuel mixes out at least one of wake and vortex regions generated downstream from the trailing edge region.

DRAWINGS

These and other features, aspects, and advantages of the present invention will become better understood when the following detailed description is read with reference to the accompanying drawings in which like characters represent like parts throughout the drawings, wherein.

While the above-identified drawing figures set forth alternative embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION

Figure 1:
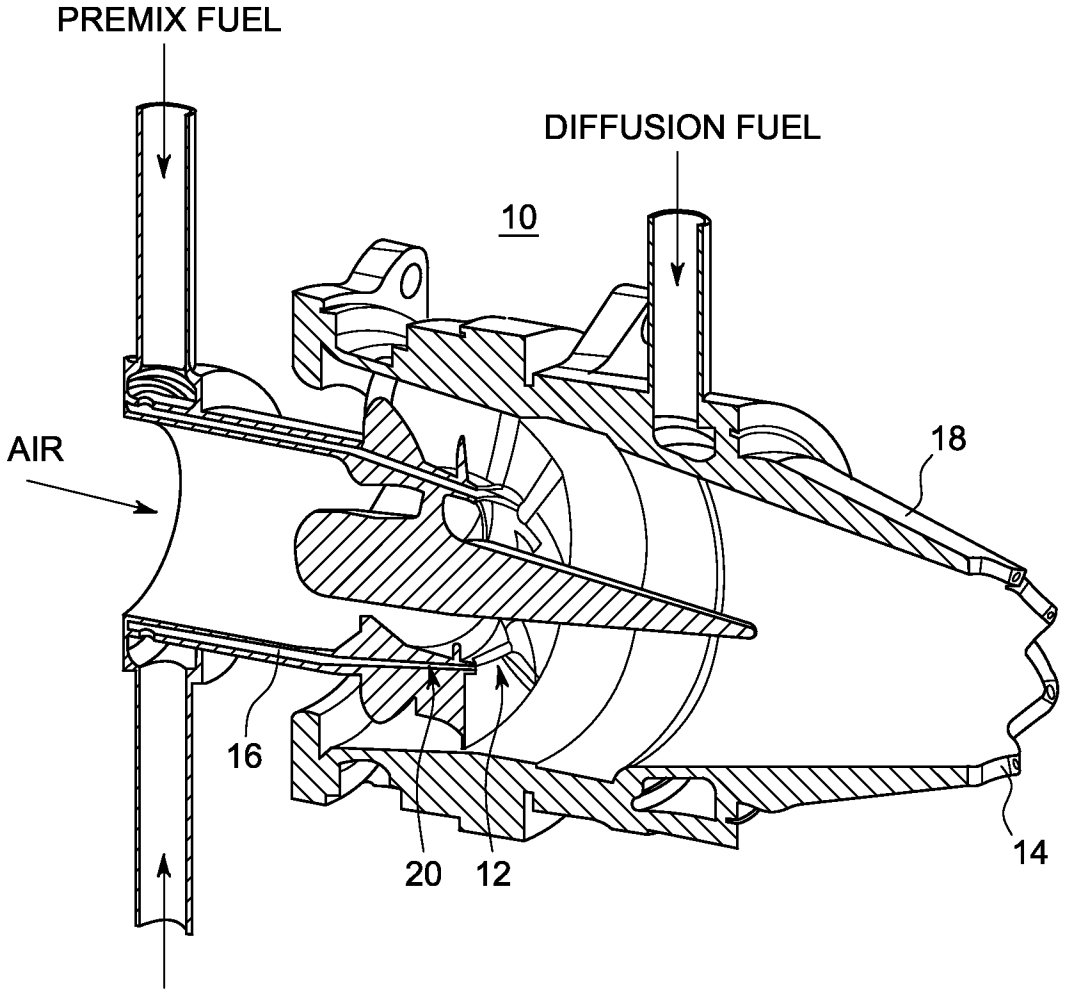
FIG. 1 is a cutaway perspective view illustrating a combustion system premixer with streamwise vortex generators, according to one embodiment.

FIG. 1 is a cutaway perspective view illustrating a combustion system premixer 10 with a plurality of streamwise vortex generators 12, 14, according to one embodiment. Streamwise vortex generator, as described herein, means a structure that generates a substantial amount of streamwise vorticity, and in some applications, may include a properly configured chevron structure that generates a substantial amount of streamwise vorticity when associated with a particular nozzle size and geometry. Streamwise vortex generators 12 are located on the trailing edge of a swirler mechanism 16. Streamwise vortex generators 14 are located on the trailing edge of the premixer nozzle 18. Streamwise vortex generators 12, 14 operate to passively redirect small amounts surrounding high velocity air into wake and vortex regions within and/or downstream of the premixer 10 to minimize turbulent flow structures in response to air flowing through the premixer 10. This passive redirection of surrounding high velocity air into wake and vortex regions via streamwise vortex generator structures applied to a combustion system premixer was discovered by the present inventors to increase flame-holding resistance for the combustion system premixer 10. Further, the passive redirection of surrounding high velocity air into wake and vortex regions via streamwise vortex generator structures was found to advantageously enhance fuel/oxidizer mixing with the premixer 10. A more detailed description of wake and vortex regions is discussed herein with reference to FIG. 8 and also described by Knowles and Saddington, "A review of jet mixing enhancement for aircraft propulsion applications".

It is noted that passive mixing techniques described herein may also be used to minimize regions of momentum deficit within the premixer 10. Although some embodiments are described herein as modified chevron type structures that are properly configured to generate streamwise vortices, chevron structures may manifest themselves as notches such as depicted herein with reference to FIG. 8, shaped grooves, or serrations on the premixer vane trailing edge such as depicted herein with reference to FIG. 9, or other forms such as chevron enhanced lobes depicted herein with reference to FIG. 7 and also described by Hu, Sago, Kobayashi, "A study on a lobed jet mixing flow by using stereoscopic particle image velocimetry technique".

Although FIG. 1 illustrates a premixer 10 with possible locations to add streamwise vortex generators, other locations such as, for example, premixer inner flow path walls or outer vane walls are possible using the principles described herein. Streamwise vortex generators then may be placed in strategic locations within premixer 10 dependent upon the desired application and the degree to which the streamwise vortex generators enhance air/fuel mixing. The streamwise vortex generators may also be used to adjust the air/fuel mixing ratio, and/or to provide a mechanism for wake filling, to substantially eliminate the possibility of flashback and flame-holding inside a fuel nozzle that may lead to hardware damage.

According to one aspect, the premixer 10 may receive air from a source such as, but not limited to, a compressor discharge plenum or outer liner annulus. Streamwise vortex generator shaped injection orifices 13 (FIG. 2) in the premixer vane trailing edge 20 and/or inner and outer vane walls passively redirect surrounding high velocity air flowing through and past the streamwise vortex generator structures 12 into wake and vortex regions within the premixer 10 to increase air/fuel mixing and/or flame-holding resistance under unique circumstances described in further detail herein. Streamwise vortex generator shaped injection orifices 15 (FIG. 5) in the premixer nozzle 18 trailing edge and/or inner and/or outer nozzle walls passively redirect surrounding high velocity air flowing through and past the streamwise vortex generator structures 14 into wake and vortex regions downstream from the premixer nozzle 18, to further increase air/fuel mixing and/or flame-holding resistance under unique circumstances described in further detail herein.

Figure 2:
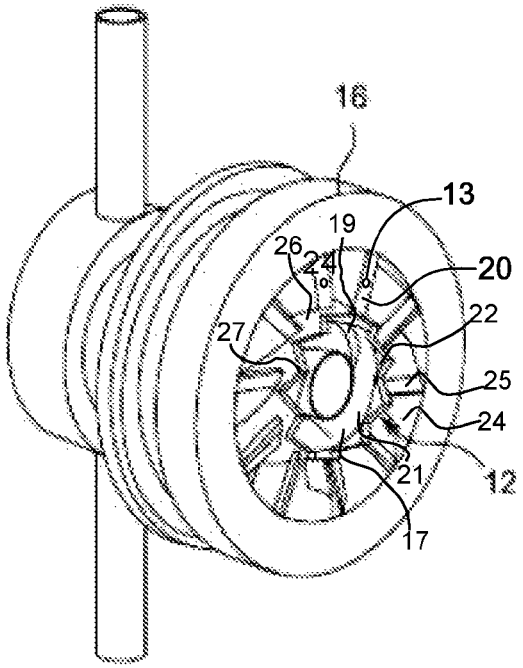
FIG. 2 is a perspective view illustrating streamwise vortex generators on the swirler portion of the premixer depicted in FIG. 1.
Figure 5:
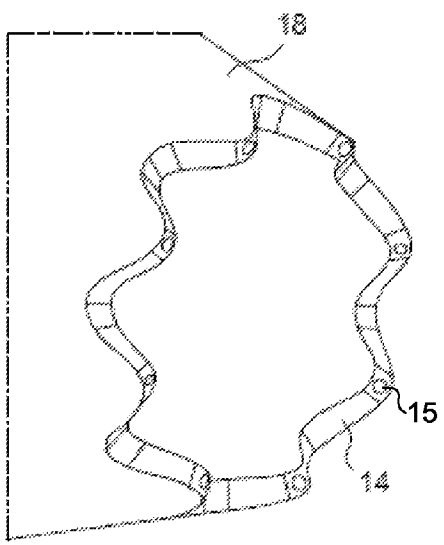
FIG. 5 is a more detailed perspective view illustrating streamwise vortex generators on the trailing edge portion of the premixer depicted in FIG. 1.

According to another aspect, the combustion system premixer 10 comprises at least one trailing edge region 20 comprising one or more injection orifices 13, 15 such as depicted in FIGS. 2 and 5, respectively. One or more streamwise vortex generators 12 are configured to passively redirect surrounding high velocity air or fuel injected into the trailing edge region 20 via the one or more injection orifices 13, 15 such that the injected air or fuel is redirected into at least one of wake and vortex regions generated downstream from the trailing edge region 20. In one embodiment, at least one injection orifice is substantially aligned with air flowing through the trailing edge region. In another embodiment, at least one injection orifice is substantially misaligned with air flowing through the trailing edge region. Furthermore, the injection of air or fuel may be substantially constant or may be pulsatile.

Figure 3:
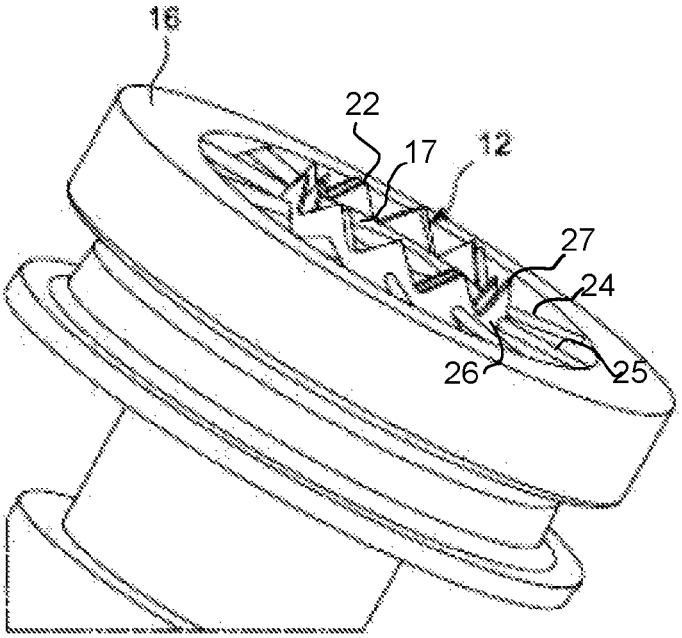
FIG. 3 is another perspective view illustrating streamwise vortex generators on the swirler portion of the premixer depicted in FIG. 1.
Figure 6:
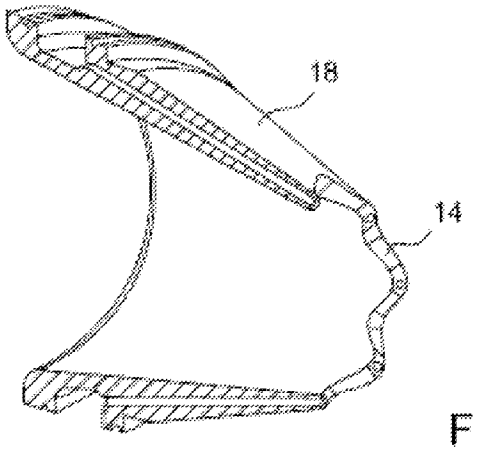
FIG. 6 is a cutaway perspective view illustrating streamwise vortex generators on the trailing edge portion of the premixer depicted in FIG. 1.
Figure 4:
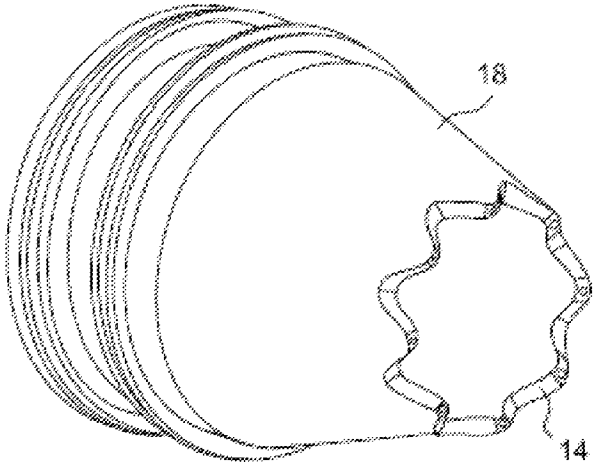
FIG. 4 is a perspective view illustrating streamwise vortex generators on the trailing edge portion of the premixer depicted in FIG. 1.

FIGS. 2 and 3 illustrate more detailed views of the swirler mechanism 16 and trailing edge chevrons 12. As illustrated in FIGS. 2 and 3, the swirler mechanism 16 includes a first annular component 17 and a second annular component 24 disposed about the first annular component 17. The first annular component 17 comprises a series of rotating air flow turning vanes 19 and a downstream edge portion 21 including a first series of trailing edge chevrons 27 generally extending in a downstream direction. The second annular component 24 comprises a second series of counter-rotating, or co-rotating, air flow turning vanes 25 and a downstream edge portion 26 including a second series of trailing edge chevrons 27 generally extending in a downstream direction. The first and second series of trailing edge chevrons 22, 27 comprise the trailing edge chevrons 12. FIGS. 4, 5 and 6 illustrate more detailed views of the premixer nozzle 18 trailing edge streamwise vortex generators 14.

Figure 7:
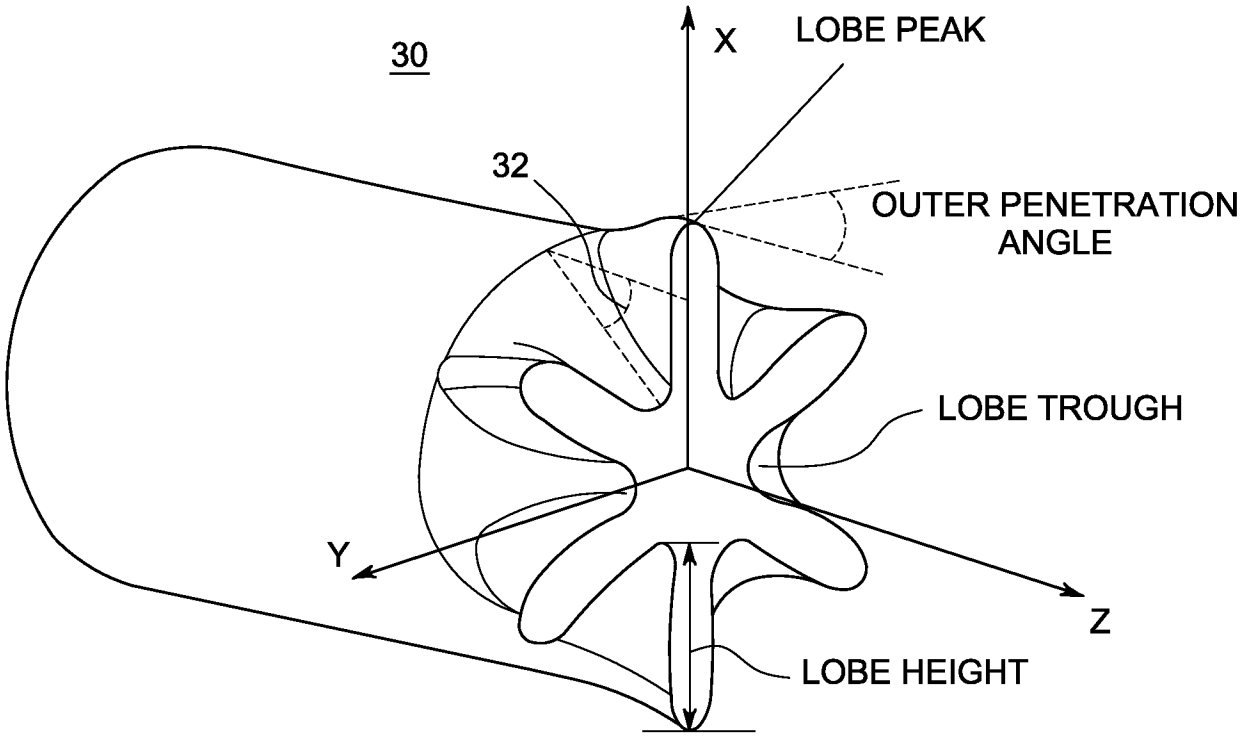
FIG. 7 (PRIOR ART)
FIG. 7 is a perspective view illustrating a lobed nozzle that employs streamwise vortex generator regions and that is suitable for use to implement the trailing edge portion of the premixer depicted in FIG. 1, according to one embodiment.

FIG. 7 is a perspective view illustrating one embodiment of a lobed nozzle 30 that employs streamwise vortex generator regions 32 and that is suitable for use to implement the trailing edge portion of the premixer 10 depicted in FIG. 1.

Figure 9:
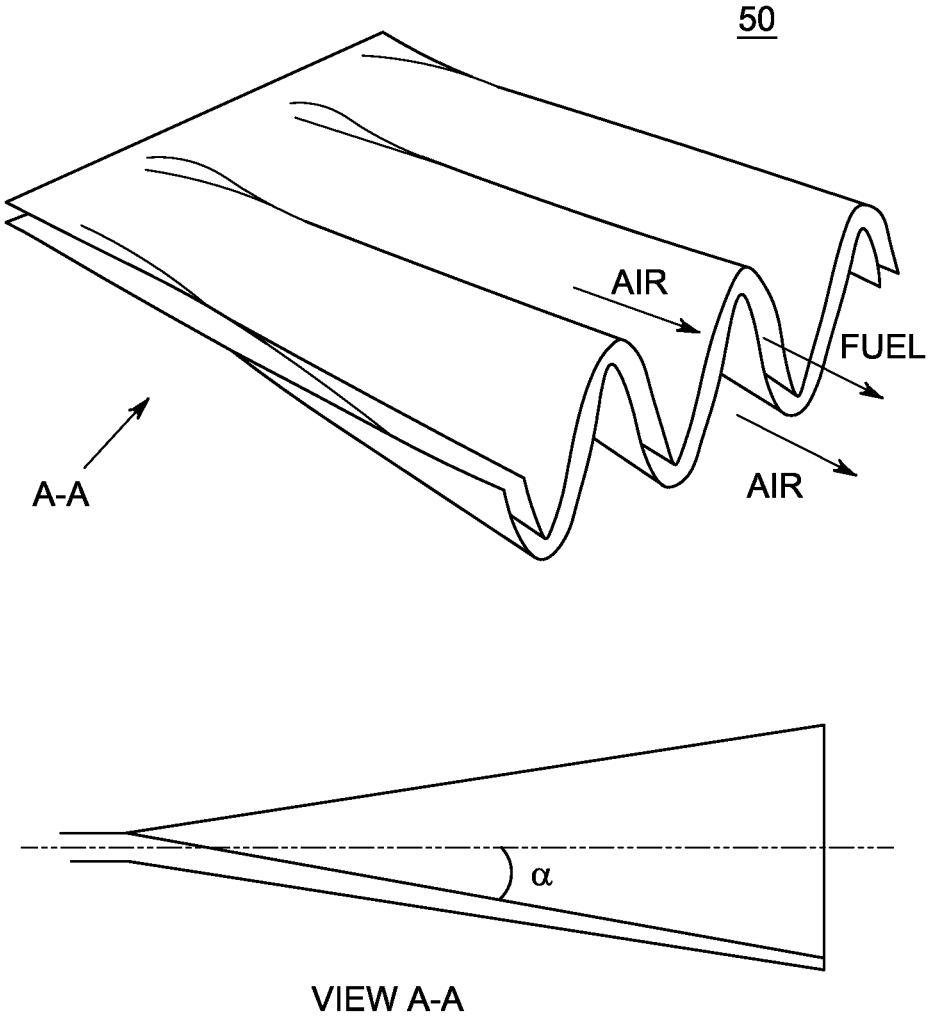
FIG. 9 (PRIOR ART)
FIG. 9 is a perspective view illustrating another streamwise vortex generator geometry suitable to implement one or more of the streamwise vortex generator regions of the premixer depicted in FIG. 1.

FIG. 9 is a perspective view illustrating another streamwise vortex generator geometry 50 suitable to implement one or more of the streamwise vortex generator regions of the premixer 10 depicted in FIG. 1.

Figure 8:
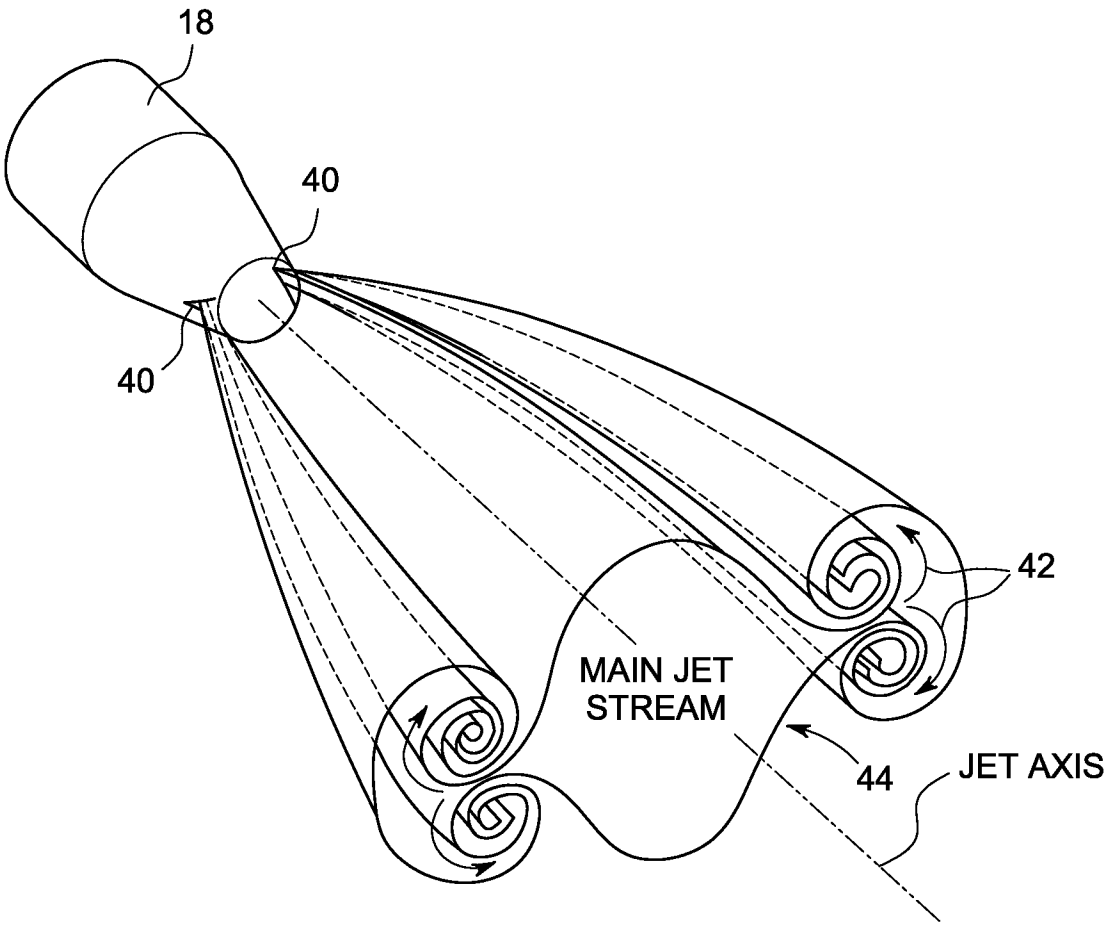
FIG. 8 (PRIOR ART)
FIG. 8 is a perspective view illustrating a pair of streamwise vortex generator notches disposed near the trailing edge portion of the premixer depicted in FIG. 1.

FIG. 8 is a perspective view illustrating a pair of streamwise vortex generator notch structures 40 disposed near the trailing edge portion of the premixer nozzle 18 depicted in FIG. 1. FIG. 8 illustrates the formation of trailing vortices 42 created by the streamwise vortex generator notches 40. These resultant vortices 42 may be employed to enhance wake filling associated with a corresponding air stream 44. These resultant vortices 42 may further be employed to enhance mixing between a corresponding fuel and an oxidizer. One added benefit that may result from the use of such streamwise vortex generator structures is related to noise and vibration reduction, since introducing streamwise vortex generators into the premixer 10 structure has the potential for reducing combustion dynamics.

The combustion system premixer embodiments described herein function to solve the challenges of premixing in gas turbine combustion systems, by enabling the premixing process to be more resistant to flame-holding, while simultaneously retaining or enhancing air/fuel mixing within the premixer. More specifically, these embodiments introduce streamwise vortex generator structures added to a dry low NOx (DLN) type fuel premixer to passively fill in and/or substantially eliminate the wakes within a nozzle, thus reducing or eliminating a potential source of flame-holding and flash-back that may be a source of hardware damage. Streamwise vortex generator structures were also discovered by the present inventors as a successful means for achieving enhanced mixing, to reduce gas turbine emissions, particularly NOx emissions, due to increasing the level of premixing within a combustion system premixer. Combustion dynamics in a combustor may also be reduced through the application of streamwise vortex generator structures to a combustion system premixer due to modification of the standard methods generally associated with premixing fuel and oxidizer.

Figure 10:
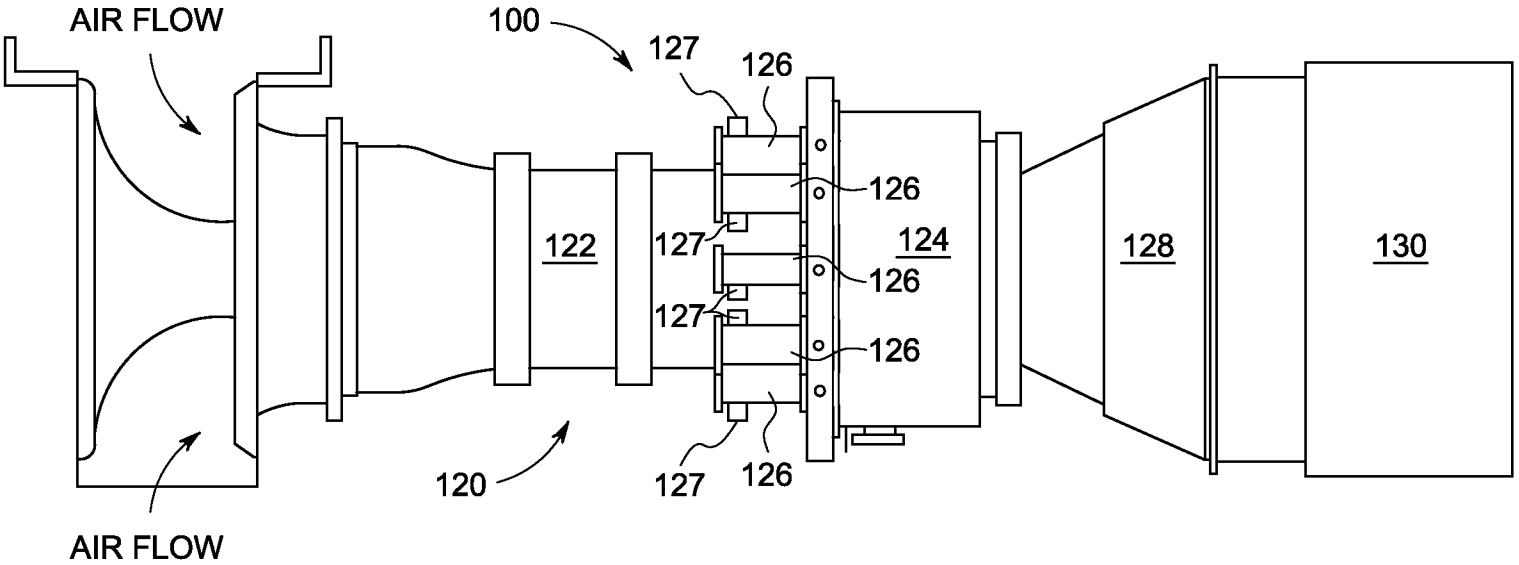
FIG. 10 illustrates one embodiment of a gas turbine engine suitable to employ premixer embodiments using the streamwise vortex generator structure principles described herein.

FIG. 10 illustrates one embodiment of a gas turbine engine 120, suitable to employ premixer embodiments using the streamwise vortex generator structure principles described herein. It shall be understood that the embodiments and principles described herein with reference to the figures, apply to all types of gas turbine combustors, and not merely land based gas turbine combustors. Turbine system 100 may have, among other systems, a gas turbine engine 120. Gas turbine engine 120 includes a compressor section 122, a combustor section 124 including a plurality of combustor cans 126 and a corresponding ignition system 127, and a turbine section 128 coupled to compressor section 122. An exhaust section 130 channels exhaust gases from gas turbine engine 120.

In general, compressor section 122 compresses incoming air to combustor section 124 that mixes the compressed air with a fuel, and burns the mixture to produce high-pressure, high-velocity gas. Turbine section 128 extracts energy from the high-pressure, high-velocity gas flowing from the combustor section 124. Only those aspects of gas turbine system 100 useful to illustrate the use of premixer streamwise vortex generator structures have been discussed herein, to enhance clarity and preserve brevity.

Compressor section 122 may include any device capable of compressing air. This compressed air may be directed to an inlet port of combustor section 124. Combustor section 124 may include a plurality of fuel injectors configured to mix the compressed air with a fuel and deliver the mixture to one or more combustor cans 126 of combustor section 124. The fuel delivered to each combustor can 126 may include any liquid or gaseous fuel, such as diesel or natural gas. The fuel delivered to any combustor can 126 may undergo combustion to form a high pressure mixture of combustion byproducts. The resultant high temperature and high pressure mixture from combustor section 124 may be directed to turbine section 128. Combustion gases may then exit turbine section 128 before being discharged to the atmosphere through exhaust section 130.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A combustion system premixer comprising:

one or more streamwise vortex generators configured to passively redirect surrounding high velocity air into at least one of wake and vortex regions within a combustion system fuel nozzle to reduce turbulent flow structures in response to the high velocity air passing therethrough;

wherein the one or more streamwise vortex generators comprise at least one notch structure, at least one shaped groove, or at least one serration extending axially with respect to a longitudinal axis of a swirler mechanism and forming a trailing edge of a downstream edge portion of a first annular component of the swirler mechanism of the combustion system premixer and at least one notch structure, at least one shaped groove, or at least one serration extending axially with respect to a longitudinal axis of the swirler mechanism and forming a trailing edge of a downstream portion of a second annular component of the swirler mechanism concentric with the first annular component; and wherein the first component of the swirler mechanism comprises swirler vanes extending radially outward of the trailing edge.

2. The combustion system premixer according to claim 1, wherein at least one streamwise vortex generator is configured to generate vortices in response to air passing through the premixer, such that the vortices passively fill in a wake region associated with the air passing through the premixer, and further, such that flame-holding resistance is increased within the premixer.

3. The combustion system premixer according to claim 1, wherein at least one streamwise vortex generator is configured to generate vortices in response to air passing through the premixer, such that the vortices passively fill in a wake region associated with the air passing through the premixer, and further such that flash-back resistance is increased within the premixer.

4. The combustion system premixer according to claim 1, wherein the premixer comprises a dry low nitrogen oxide (DLN) type fuel premixer.

5. A combustion system premixer comprising:

a swirler mechanism comprising a first annular component and a second annular component concentric with the first annular component, the first annular component including a first series of rotating air flow turning vanes and a downstream portion, the second annular component including a second series of one of counter-rotating or co-rotating air flow turning vanes, and a downstream portion;

one or more injection orifices, and a trailing edge of the downstream portion of the first annular component of the swirler mechanism comprising one or more streamwise vortex generators and a trailing edge of the downstream portion of the second annular component of the swirler mechanism comprising one or more streamwise vortex generators, wherein each of the streamwise vortex generators comprise at least one notch structure, at least one shaped groove, or at least one serration extending axially with respect to a longitudinal axis of the swirler mechanism and forming the trailing edge, and wherein each of the streamwise vortex generators are configured to passively redirect surrounding high velocity air or fuel injected into the trailing edge region via the one or more injection orifices such that the redirected air or fuel mixes out at least one of wake and vortex regions generated downstream from the trailing edge regions.

6. The combustion system premixer according to claim 5, wherein at least one injection orifice is substantially aligned with air flowing through a trailing edge region.

7. The combustion system premixer according to claim 5, wherein at least one injection orifice is substantially misaligned with air flowing through a trailing edge region.

8. The combustion system premixer according to claim 5, wherein the injection of air or fuel is substantially constant.

9. The combustion system premixer according to claim 5, wherein the injection of air or fuel is pulsatile.

* * * * *